US011471369B2

(12) United States Patent
Nelson

(10) Patent No.: US 11,471,369 B2
(45) Date of Patent: Oct. 18, 2022

(54) MASSAGE ROLLER

(71) Applicant: Roll Recovery, LLC, Boudler, CO (US)

(72) Inventor: Jeremy J. Nelson, Boulder, CO (US)

(73) Assignee: Roll Recovery, LLC, Boulder, CO (US)

( * ) Notice: Subject to any disclaimer, the term of this patent is extended or adjusted under 35 U.S.C. 154(b) by 131 days.

(21) Appl. No.: 15/231,455

(22) Filed: Aug. 8, 2016

(65) Prior Publication Data

US 2017/0042756 A1 Feb. 16, 2017

Related U.S. Application Data

(63) Continuation-in-part of application No. 29/556,042, filed on Feb. 26, 2016, now Pat. No. Des. 777,340.

(60) Provisional application No. 62/203,033, filed on Aug. 10, 2015.

(51) Int. Cl.
*A61H 15/00* (2006.01)

(52) U.S. Cl.
CPC ..... *A61H 15/00* (2013.01); *A61H 2015/0014* (2013.01); *A61H 2201/1261* (2013.01); *A61H 2201/1284* (2013.01); *A61H 2201/164* (2013.01); *A61H 2201/1671* (2013.01); *A61H 2205/12* (2013.01)

(58) Field of Classification Search
CPC .. A61H 15/00; A61H 2015/0007–0014; A61H 15/02; A61H 2201/1671; A61H 2201/164; A61H 2201/1284; A61H 2201/1261; A61H 2205/12
USPC ..... 601/19, 118
See application file for complete search history.

(56) References Cited

U.S. PATENT DOCUMENTS 1,400,547 A 12/1921 Holmstrom
1,722,866 A * 7/1929 Earls ..... A61H 15/00 601/121

(Continued)

FOREIGN PATENT DOCUMENTS

AU 2017100741 7/2017
AU 2017101795 2/2018

(Continued)

OTHER PUBLICATIONS

Ebay. New PTP Foot Roller from Rebel Sport. Website, http://www.ebay.com.au, originally downloaded May 15, 2017, 3 pages total.

(Continued)

*Primary Examiner* — Rachel T Sippel
*Assistant Examiner* — Jacqueline M Pinderski
(74) *Attorney, Agent, or Firm* — Craig R. Miles; CR Miles P.C.

(57) ABSTRACT

Disclosed herein are embodiments of a massage roller, and methods of making and using such a massage roller, whereby the massage roller includes a massage roller body comprising a generally circular cross section, opposing first and second end portions, a convex medial portion, a first concave lateral portion axially extending between the first end portion and the convex medial portion, and a second concave lateral portion axially extending between the second end portion and the convex medial portion; wherein said massage roller body is asymmetric about a massage roller body vertical centerline.

19 Claims, 10 Drawing Sheets

(56) References Cited

U.S. PATENT DOCUMENTS

| | | | | | |
|---|---|---|---|---|---|
| 1,962,971 | A | * | 6/1934 | Schipper | A61H 15/00 601/121 |
| 1,999,939 | A | | 4/1935 | Luzzi | |
| 2,104,927 | A | * | 1/1938 | Hussmann | A61H 15/00 601/121 |
| 2,121,250 | A | * | 6/1938 | Koschwitz | A61H 15/00 601/118 |
| D119,035 | S | | 2/1940 | Lindgren | |
| 2,448,797 | A | | 9/1948 | Gustlin | |
| D152,951 | S | | 3/1949 | Eldredge | |
| 2,537,037 | A | * | 1/1951 | Curtis | A61H 15/02 601/19 |
| D177,529 | S | | 4/1956 | McDermott | |
| 3,465,750 | A | | 9/1969 | Schawalder | |
| D225,907 | S | | 1/1973 | Shiu | |
| 3,759,250 | A | | 9/1973 | Salata | |
| 4,109,649 | A | | 8/1978 | Iyomasa | |
| D253,373 | S | | 11/1979 | Celeste | |
| 4,210,135 | A | | 7/1980 | Deuser | |
| D256,503 | S | | 8/1980 | Moustakas | |
| 4,378,007 | A | | 3/1983 | Kachadourian | |
| 4,945,900 | A | | 8/1990 | Masuda | |
| D337,827 | S | | 7/1993 | Seng | |
| D353,008 | S | | 11/1994 | Van Harn | |
| D357,952 | S | | 5/1995 | Chen | |
| D384,161 | S | | 9/1997 | Tseng | |
| 5,735,803 | A | | 4/1998 | Musilli | |
| D399,569 | S | | 10/1998 | Wier et al. | |
| 5,830,161 | A | | 11/1998 | Cosmano | |
| D427,391 | S | | 6/2000 | Gill | |
| D446,584 | S | | 8/2001 | Chen | |
| 6,499,485 | B1 | * | 12/2002 | Pepera | A61H 15/02 601/134 |
| D475,464 | S | | 6/2003 | Chen | |
| D491,271 | S | | 6/2004 | Siegfried | |
| D491,671 | S | | 6/2004 | Kim | |
| 6,793,636 | B1 | | 9/2004 | Perera | |
| 6,974,427 | B1 | | 12/2005 | Lapham | |
| D513,816 | S | | 1/2006 | Crane et al. | |
| 7,223,251 | B1 | | 5/2007 | Philips | |
| D626,706 | S | | 11/2010 | Ragonetti | |
| D639,974 | S | | 6/2011 | Kurosu et al. | |
| D646,793 | S | | 10/2011 | Wagner | |
| D648,034 | S | * | 11/2011 | Rice | D24/215 |
| D650,487 | S | | 12/2011 | Briscoe | |
| D650,537 | S | | 12/2011 | Oblack et al. | |
| D676,140 | S | | 2/2013 | Feightner | |
| D687,159 | S | * | 7/2013 | Cho | D24/215 |
| D688,380 | S | | 8/2013 | Nelson | |
| D689,155 | S | | 9/2013 | Jahns | |
| D700,346 | S | | 2/2014 | Palizzi | |
| D709,559 | S | | 7/2014 | Baumann et al. | |
| D709,562 | S | | 7/2014 | Baumann et al. | |
| D709,564 | S | * | 7/2014 | Baumann | D21/398 |
| D711,546 | S | | 8/2014 | Babiarz | |
| D718,461 | S | | 11/2014 | Sato | |
| D751,724 | S | | 3/2016 | Nelson | |
| 2002/0165073 | A1 | | 11/2002 | Tsai et al. | |
| 2004/0254508 | A1 | | 12/2004 | Lee | |
| 2005/0159688 | A1 | | 7/2005 | Sakamoto et al. | |
| 2005/0203445 | A1 | | 9/2005 | Tsai | |
| 2007/0173750 | A1 | | 7/2007 | Hudock | |
| 2008/0103421 | A1 | | 5/2008 | Nicholson | |
| 2010/0185128 | A1 | | 7/2010 | Galvez Campos | |
| 2011/0137218 | A1 | | 6/2011 | Collins | |
| 2012/0065557 | A1 | * | 3/2012 | Phillips | A61H 15/0092 601/99 |
| 2012/0209363 | A1 | | 8/2012 | Williams, III et al. | |
| 2013/0184620 | A1 | | 7/2013 | Cohen | |
| 2015/0148721 | A1 | * | 5/2015 | De Nitto | A61H 15/0092 601/118 |
| 2015/0313789 | A1 | * | 11/2015 | Babiarz | A61H 15/02 601/19 |

FOREIGN PATENT DOCUMENTS

| | | | |
|---|---|---|---|
| CN | 2399054 | | 10/2000 |
| CN | 2399054 | Y | 10/2000 |
| GB | 353894 | A | 7/1931 |
| GB | 2375307 | | 11/2002 |
| JP | 53-082294 | | 12/1951 |
| JP | 55-131738 | | 3/1954 |
| JP | 56-063435 | | 10/1954 |
| JP | H11267167 | | 10/1999 |
| JP | 2003-019173 | | 1/2003 |
| JP | 2004-097459 | | 4/2004 |
| JP | 2007-130327 | | 5/2007 |
| WO | 2015/077323 | | 5/2015 |

OTHER PUBLICATIONS

PTP. Foot Roller—PTPfit. Website, https://www.ptpfit.com, originally downloaded May 3, 2015, 8 pages total.
PCT International Patent Application No. PCT/US16/46357; International Search Report and Written Opinion of the International Searching Authority dated Oct. 26, 2016, 14 pages.
U.S. Appl. No. 62/203,033, filed Aug. 10, 2015.
International Patent Cooperation Treaty Patent Application No. PCT/US2012/063750, filed Nov. 6, 2012.
U.S. Appl. No. 61/628,882, filed Nov. 7, 2011.
Design U.S. Appl. No. 29/556,042, filed Feb. 26, 2016.
U.S. Appl. No. 14/350,561, filed Apr. 8, 2014.
Corresponding European Patent Application No. 12848115.7; Office Action dated May 18, 2015, 7 pages total.
U.S. Appl. No. 15/201,230, filed Jul. 1, 2016.
Corresponding Australian Patent Application No. 2017101795, Examination Report No. 1, dated Mar. 15, 2018, 5 pages.
Corresponding Australian Patent Application No. 2016304872; Examination Report No. 2, dated May 3, 2019, 3 pages.
Corresponding Australian Patent Application No. 2016304872, Examination Report No. 1, dated Feb. 14, 2019, 3 pages.
Corresponding European patent application No. 16835841.4; extended European Search Report dated Feb. 19, 2019, 6 pages.
Amazon. Wooden Foot Roller. Website, https://www.amazon.com, originally downloaded Aug. 26, 2019, 7 pages.
Triggerpoint. Nano® Foot Roller. Website, https://triggerpoint.impuls.com, originally downloaded Aug. 26, 2019, 5 pages.
Corresponding Australian Patent Application No. 2016304872; Examination Report No. 2, dated Jun. 6, 2019, 3 pages.
Corresponding Australian Patent Application No. 2016304872; Examination Report No. 3, dated Aug. 26, 2019, 5 pages.
Australian Patent Innovation Application No. 2017100741; Examination Report No. 1, dated Aug. 1, 2017, 4 pages.
Australian Patent Innovation Application No. 2017100741; Examination Report No. 2, dated Sep. 22, 2017, 3 pages.
Australian Patent Innovation Application No. 2017101795; Examination Report No. 2, dated Jun. 5, 2018, 4 pages.
Corresponding Japanese Patent Application No. 2018-506529; Office Action dated Aug. 14, 2020, 9 pages (with English Translation).

* cited by examiner

1/4

1/4

1/4

MASSAGE ROLLER

This United States Patent Application is a continuation-in-part of U.S. patent application Ser. No. 29/556,042, filed Feb. 26, 2016, and claims the benefit of U.S. Provisional Patent Application No. 62/203,033, filed Aug. 10, 2015, each hereby incorporated by reference herein.

I. SUMMARY OF THE INVENTION

A broad object of a particular embodiment of the invention can be to provide a massage roller, and methods of making and using such a massage roller, whereby the massage roller includes a massage roller body comprising a generally circular cross section, opposing first and second end portions, a convex medial portion, a first concave lateral portion axially extending between the first end portion and the convex medial portion, and a second concave lateral portion axially extending between the second end portion and the convex medial portion; wherein said massage roller body is asymmetric about a massage roller body vertical centerline.

Naturally, further objects of the invention are disclosed throughout other areas of the specification, drawings, and claims.

II. A BRIEF DESCRIPTION OF THE DRAWINGS

III. DETAILED DESCRIPTION OF THE PREFERRED EMBODIMENTS

Figure 1:
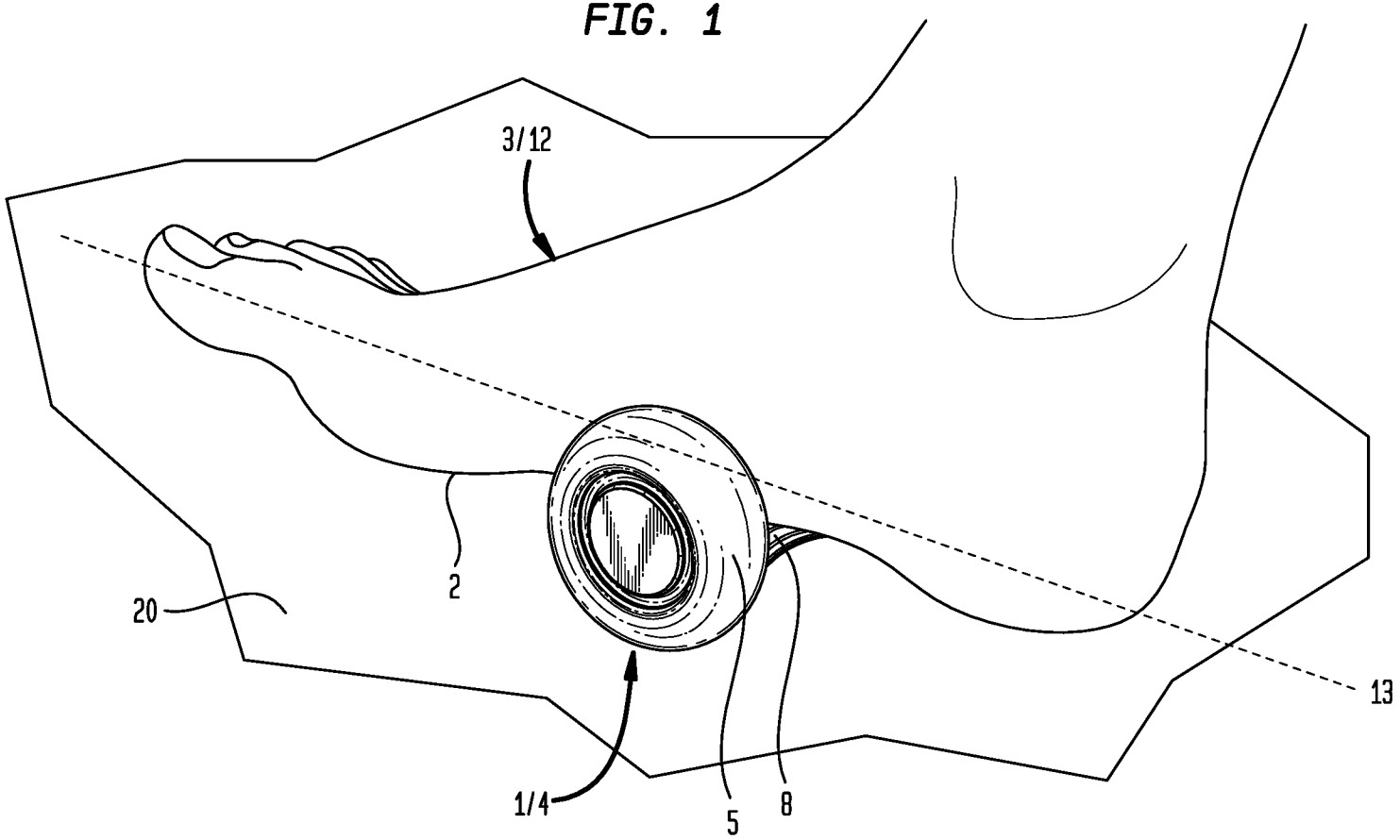
FIG. 1 is an illustration of a method of using a particular embodiment of the massage roller to massage a massageable portion of a foot.
Figure 5:
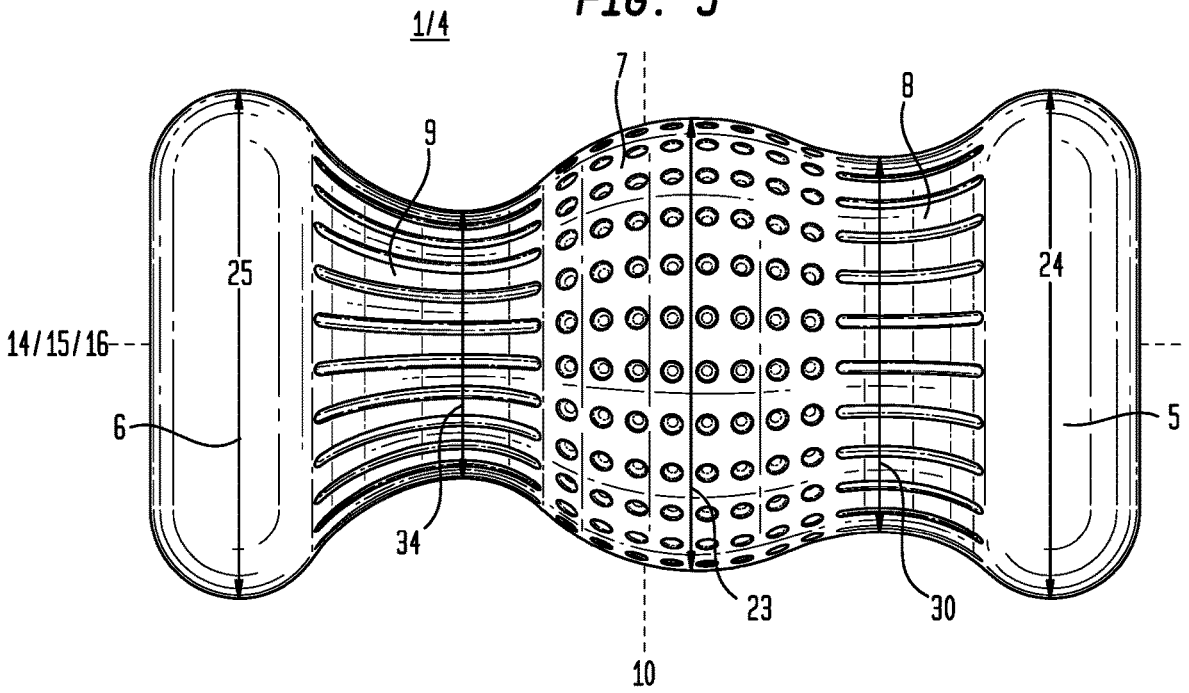
FIG. 5 is a rear view of the particular embodiment of the massage roller shown in FIG. 2 and FIG. 3.

Now referring primarily to FIG. 1, which illustrates a method of using a particular embodiment of a massage roller (1) to massage a massageable portion (2) of a body (3), whereby the massage roller (1) includes a massage roller body (4) comprising a generally circular cross section, opposing first and second end portions (5)(6), a convex medial portion (7), a first concave lateral portion (8) axially extending between the first end portion (5) and the convex medial portion (7), and a second concave lateral portion (9) axially extending between the second end portion (6) and the convex medial portion (7), whereby the massage roller body (4) is asymmetric about a massage roller body vertical centerline (10) (as shown in the example of FIG. 5). The method includes engaging the massageable portion (2) of the body (3) with an external surface (11) of the massage roller body (4) and rolling the massage roller (1) to massage the massageable portion (2) of the body (3).

For the purposes of the present invention, the term "generally circular" means a closed shape defined by a line, whereby every point on the line is about the same distance from the center of the shape. As to particular embodiments, every point can be exactly the same distance from the center of the shape, thereby forming a perfectly round circular periphery. As to other particular embodiments, the closed shape can resemble a polygon, such as a pentagon, a hexagon, a heptagon, an octagon, and so forth and so on, which can be used in various permutations of the massage roller (1).

For purposes of the present invention, the term "convex" means outwardly extending or curving.

For purposes of the present invention, the term "concave" means inwardly extending or curving.

For the purposes of the present invention, the term "medial" means toward the middle.

For the purposes of the present invention, the term "lateral" means toward the side(s) or away from the middle.

For the purposes of the present invention, the term "vertical" means positioned up and down rather than from side to side, whereby "vertical" is not intended to be limiting, particularly as to the position, orientation, or use of the invention, but instead, is intended to provide a directional reference for the depiction of the massage roller (1) shown in the Figures to aid the reader's understanding of the present invention.

For the purposes of the present invention, the term "horizontal" means positioned from side to side rather than up and down, whereby "horizontal" is not intended to be limiting, particularly as to the position, orientation, or use of the invention, but instead, is intended to provide a directional reference for the depiction of the massage roller (1) shown in the Figures to aid the reader's understanding of the present invention.

Again referring primarily to FIG. 1, as but one illustrative example, the massage roller (1) can be used to massage a massageable portion (2) of a foot (12), whereby the method can include engaging the massageable portion (2) of the foot (12) with the external surface (11) of the massage roller (1) and rolling the massage roller (1) to massage the massageable portion (2) of the foot (11). As to particular embodiments, the massageable portion (2) of the foot (12) can engage with the external surface (11) of the massage roller (1) to dispose a foot longitudinal axis (13) in angled relation to a massage roller body horizontal axis (14) (such as generally orthogonal relation), whereby massaging can be achieved by rolling the massage roller (1) with the massageable portion (2) of the foot (12) along the foot longitudinal axis (13) to rotate the massage roller (1) about a rotation axis (15) coincident with a massage roller body horizontal centerline (16).

Although the above-illustrated example includes using the massage roller (1) to massage a massageable portion (2) of a foot (12), the massage roller (1) is not limited to use for massaging only a massageable portion (2) of a foot (12), as the massage roller (1) can be used to massage any massageable portion (2) of a body (3), depending upon the application.

Figure 2:
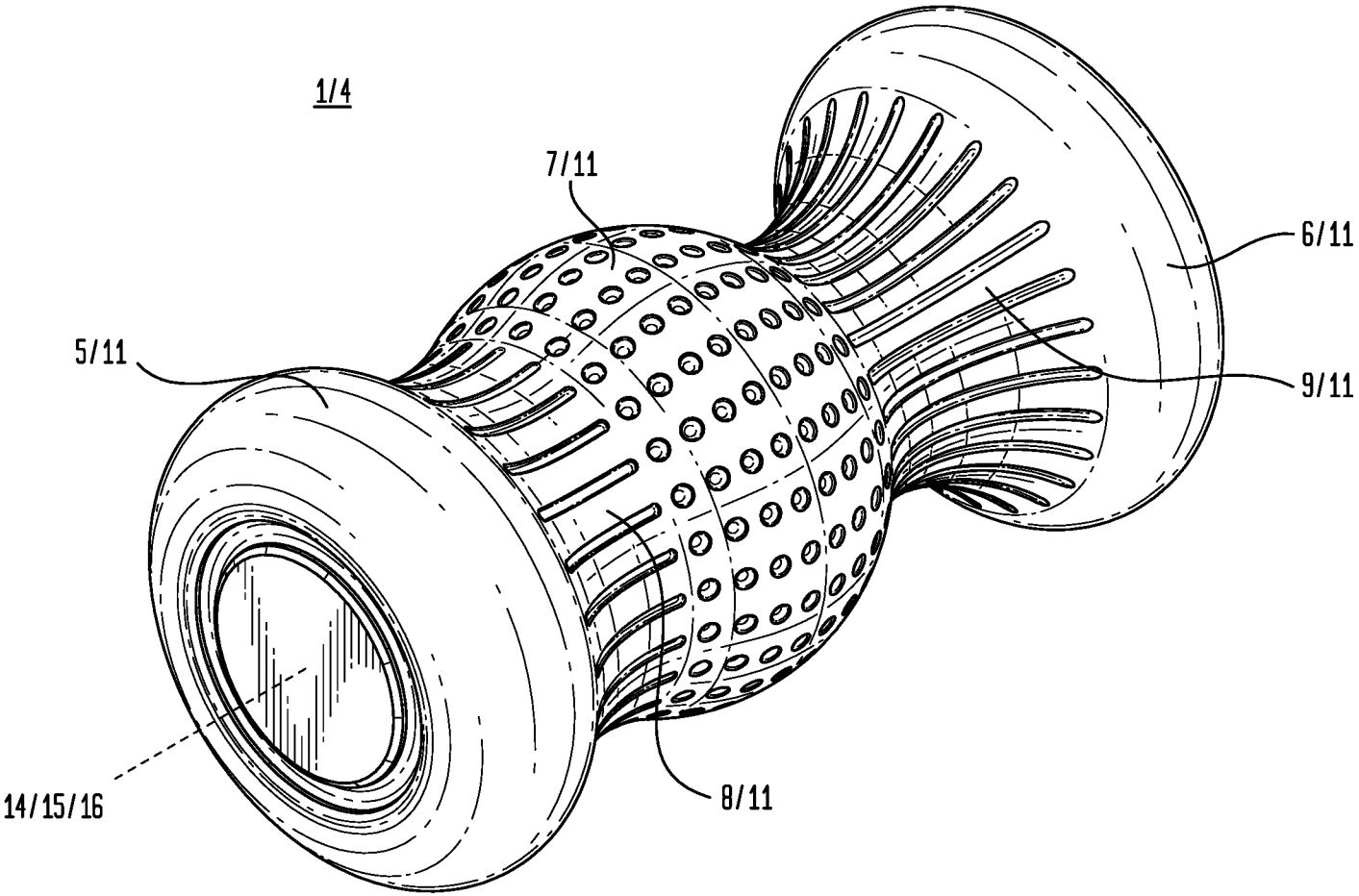
FIG. 2 is a perspective view of a particular embodiment of the massage roller.
Figure 3:
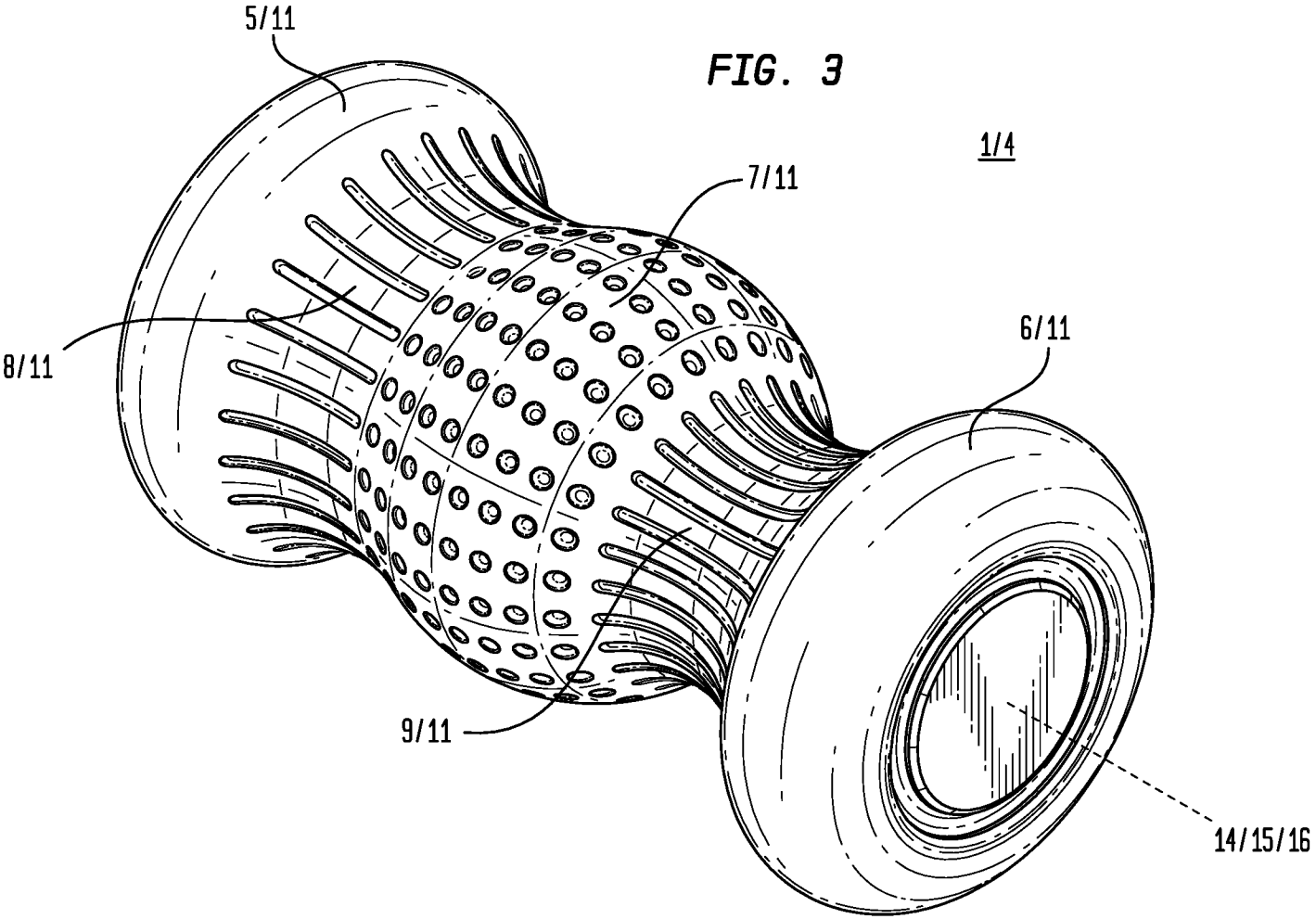
FIG. 3 is a perspective view of a particular embodiment of the massage roller.
Figure 13:
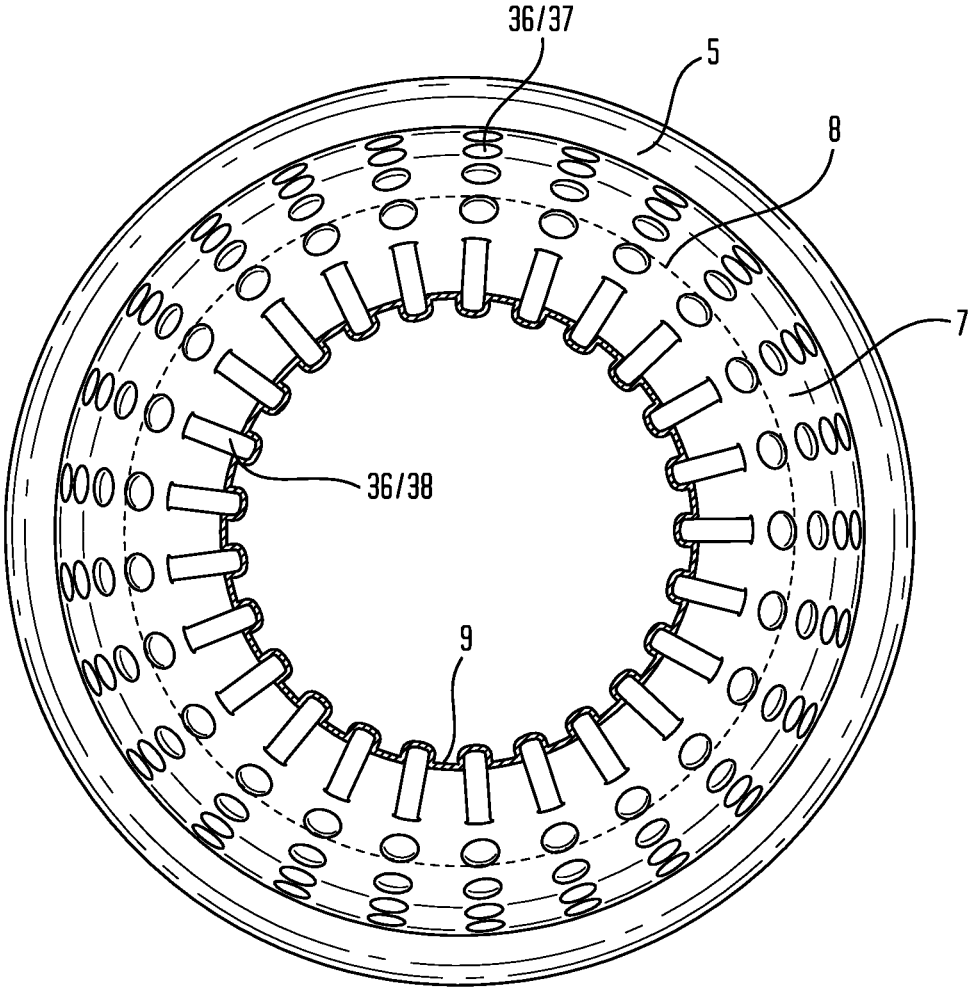
FIG. 13 is a cross-sectional view of the particular embodiment of the massage roller shown in FIG. 6, whereby the massage roller is sectioned perpendicularly to a massage roller body horizontal axis.

Now referring primarily to FIG. 2 and FIG. 3, the massage roller (1) includes a massage roller body (4) comprising a generally circular cross section when sectioned perpendicularly to the massage roller body horizontal axis (14) (as shown in the example of FIG. 13).

As to particular embodiments, the massage roller body (4) can be substantially solid.

Figure 10:
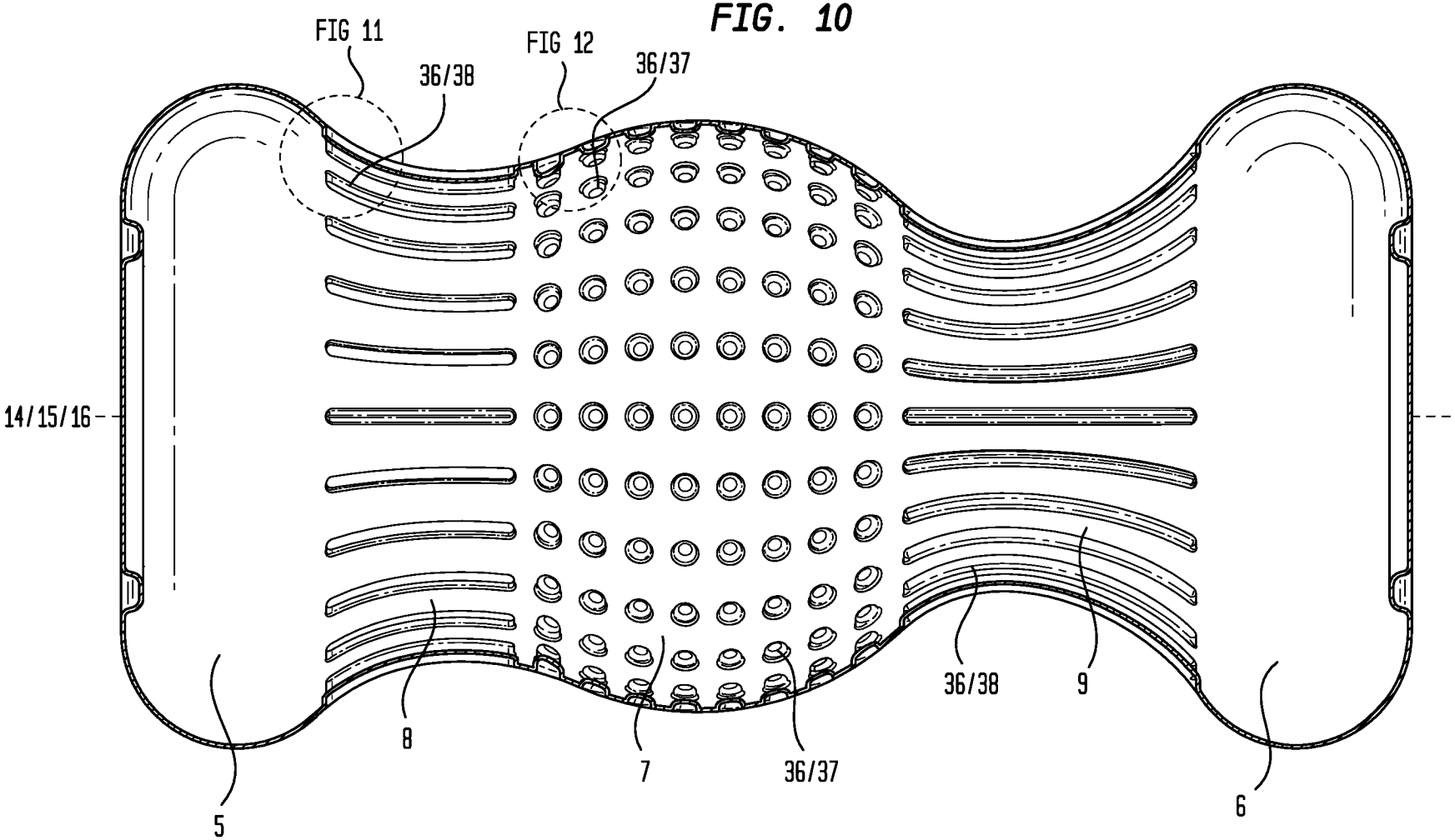
FIG. 10 is a cross-sectional view of the particular embodiment of the massage roller shown in FIG. 7, whereby the massage roller is sectioned along a massage roller body horizontal axis.

As to other particular embodiments, the massage roller body (4) can include a body wall (17) which defines a substantially hollow interior cavity (18) fillable with a gas (such as air), a liquid, or combinations thereof, depending upon the application (as shown in the example of FIG. 10). As to these embodiments, the substantially hollow interior cavity (18) can further include one or more supports (19) disposed therein, whereby the supports (19) can be configured to support the massage roller body (4) having the generally circular cross section, thereby maintaining the shape of the massage roller body (4).

As but one illustrative example, a particular embodiment of the massage roller (1) can include a body wall (17) defining a substantially hollow interior cavity (18) having a plurality of supports (19) disposed therein and filled with only gas. Consequently, the substantially hollow interior cavity (18) of this particular embodiment is void of liquid.

The massage roller body (4) can be formed from any of a numerous and wide variety of materials sufficient to permit the massage roller (1) to, upon use, massage a massageable portion (2) of a body (3). As to particular embodiments, the material, whether natural or synthetic, can be substantially rigid and may include, as non-limiting examples: metal, ceramic, plastic, wood, or the like, or combinations thereof. As to other particular embodiments, the material, whether natural or synthetic, can be a resiliently elastic material which to an extent deforms upon engagement with the massageable portion (2) of the body (3), whereby these materials can include, as non-limiting examples: plasticized resin, rubber, silicone rubber, fluoropolymer, polyurethane, or the like, or combinations thereof.

Now referring primarily to FIG. 2 through FIG. 9, the massage roller body (4) further includes opposing first and second end portions (5)(6) configured to engage with a support surface (20), whereby each of the first and second end portions (5)(6) can have a generally circular cross section, allowing the massage roller (1) to roll, or rotate about the rotation axis (15) coincident with the massage roller body horizontal centerline (16), along the support surface (20). As to particular embodiments, the first and second end portions (5)(6) can include one or more grippable elements (not shown) which facilitate gripping the support surface (20) to preclude disengagement of the massage roller (1) from the support surface (20) when in use.

Figure 4:
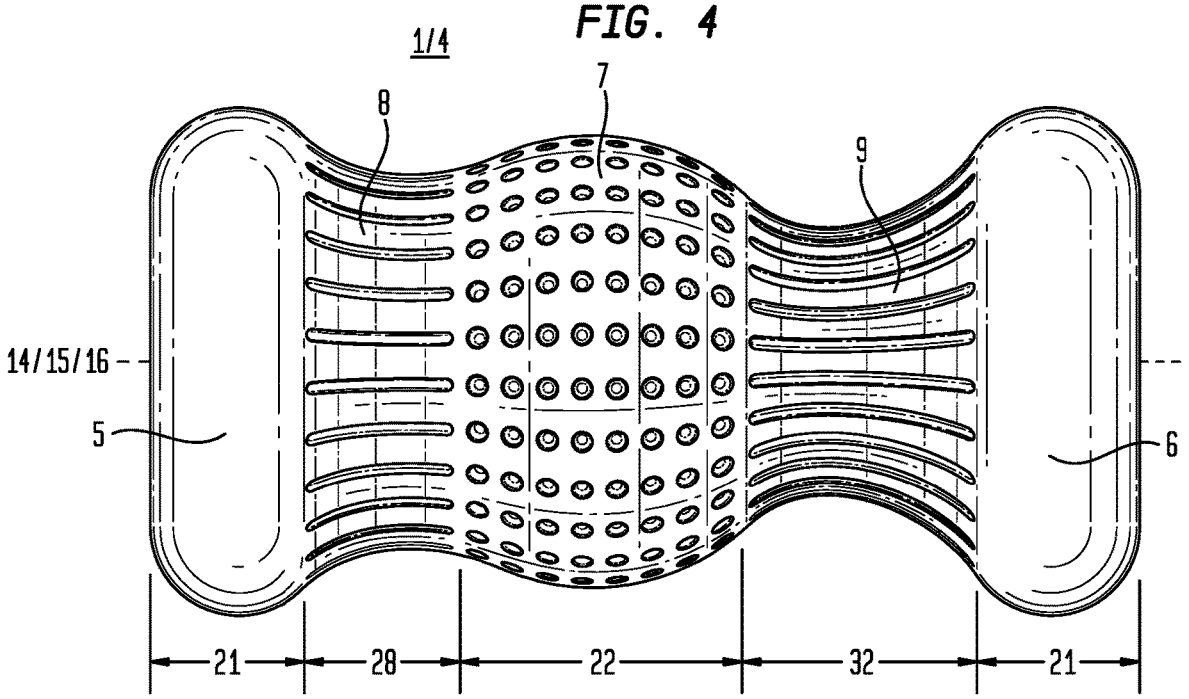
FIG. 4 is a front view of the particular embodiment of the massage roller shown in FIG. 2 and FIG. 3.

Now referring primarily to FIG. 4 through FIG. 7, each of the first and second end portions (5)(6) can be convexly arcuate along corresponding end portion lengths (21) (as shown in the example of FIG. 4).

Now referring primarily to FIG. 2 through FIG. 7, the massage roller body (4) further includes a convex medial portion (7) disposed between the first and second end portions (5)(6). Akin to the first and second end portions (5)(6), the convex medial portion (7) can be convexly arcuate along a convex medial portion length (22) (as shown in the example of FIG. 4).

Again referring primarily to FIG. 2 through FIG. 7, the convex medial portion (7) can have a convex medial portion maximum diameter (23) which is lesser than first and second end portion maximum diameters (24)(25) of the corresponding first and second end portions (5)(6) (as shown in the example of FIG. 5). As such, upon use of the massage roller (1), the convex medial portion (7) does not engage with the support surface (20), as only the first and second end portions (5)(6) engage with the support surface (20).

Figure 6:
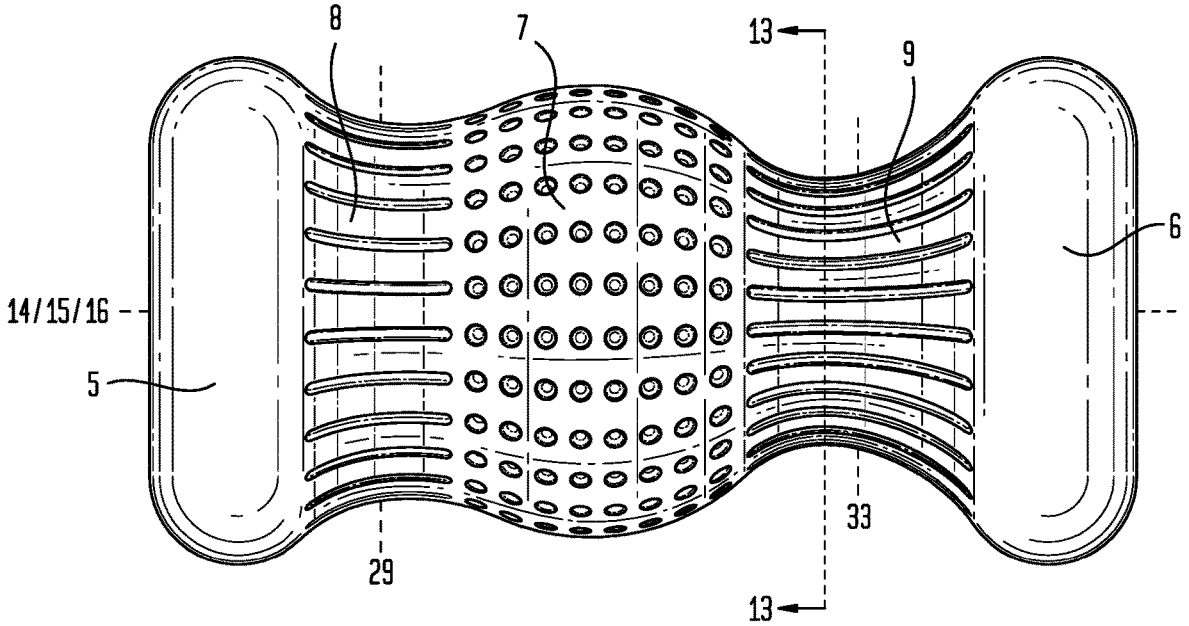
FIG. 6 is a top view of the particular embodiment of the massage roller shown in FIG. 2 and FIG. 3.
Figure 7:
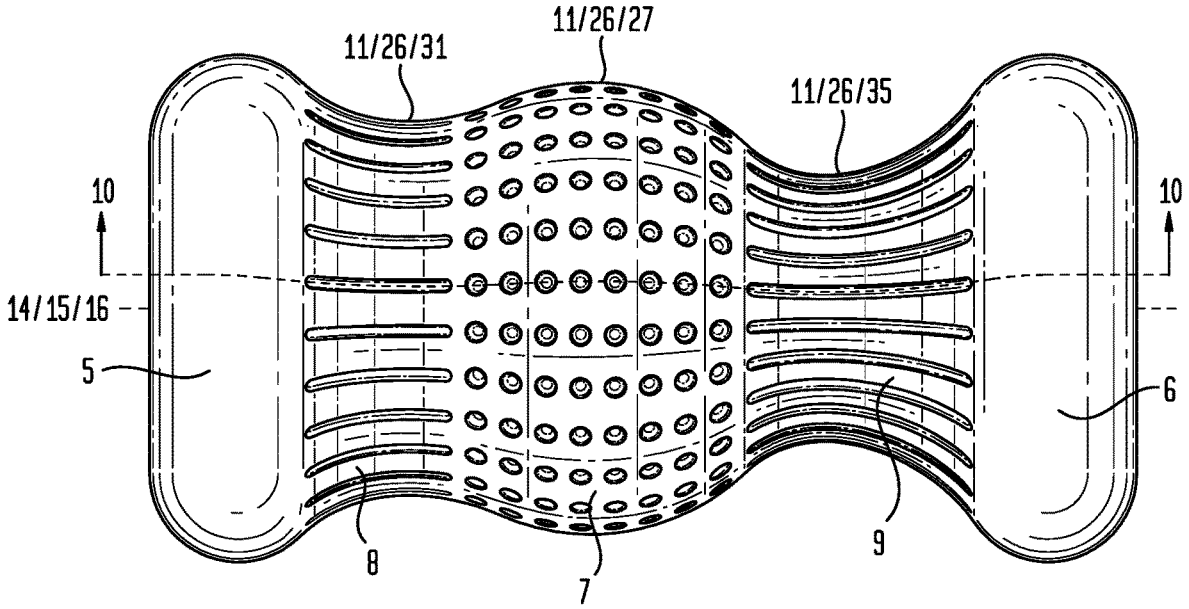
FIG. 7 is a bottom view of the particular embodiment of the massage roller shown in FIG. 2 and FIG. 3.
Figure 8:
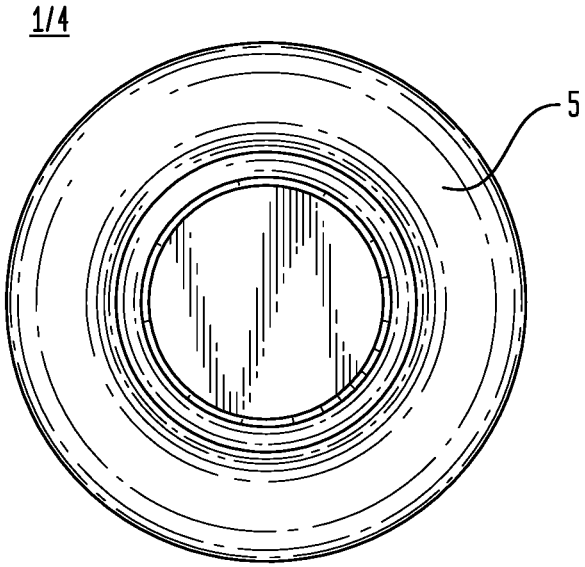
FIG. 8 is a first end view of the particular embodiment of the massage roller shown in FIG. 2 and FIG. 3.
Figure 9:
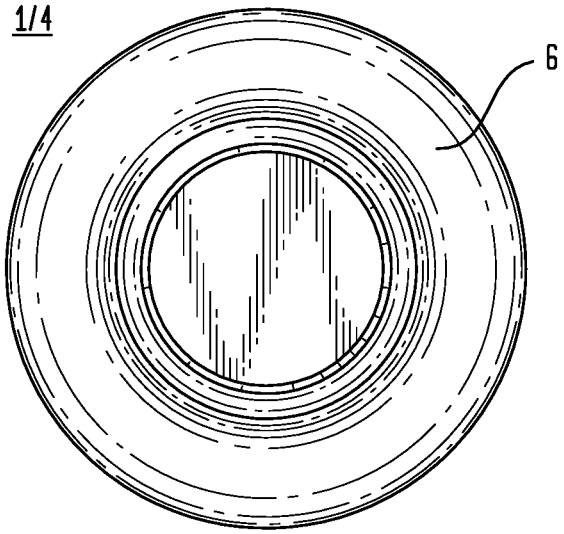
FIG. 9 is a second end view of the particular embodiment of the massage roller shown in FIG. 2 and FIG. 3.

Again referring primarily to FIG. 2 through FIG. 7, the convex medial portion (7) provides an arcuate working surface (26), which can engage with corresponding curvature of a massageable portion (2) of the body (3). In relation to a planar working surface, the arcuate working surface (26) can engage the corresponding curvature of the massageable portion (2) of the body (3) with greater uniformity, thereby providing a greater massage to the massageable portion (2) of the body (3). As but one illustrative example, the convex medial portion (7) can provide a first arcuate working surface (27) configured as a substantially spherical working surface (as shown in the example of FIG. 7), which may be useful for massaging a central longitudinal region of the sole of the foot (12), such as the central portion of the plantar fascia.

Again referring primarily to FIG. 2 through FIG. 7, the massage roller body (4) further includes a first concave lateral portion (8) axially extending between the first end portion (5) and the convex medial portion (7). In contrast to the first and second end portions (5)(6) and the convex medial portion (7), the first concave lateral portion (8) can be concavely arcuate along a first concave lateral portion length (28) (as shown in the example of FIG. 4).

As to particular embodiments, the first concave lateral portion (8) can be asymmetric about a first concave lateral portion vertical centerline (29) (as shown in the example of FIG. 6).

Now referring primarily to FIG. 5, the first concave lateral portion (8) has a first concave lateral portion minimum diameter (30) which is lesser than the convex medial portion maximum diameter (23) and the first and second end portion maximum diameters (24)(25). As such, upon use of the massage roller (1), the first concave lateral portion (8) does not engage with the support surface (20), as only the first and second end portions (5)(6) engage with the support surface (20).

Now referring primarily to FIG. 2 through FIG. 7, the first concave lateral portion (8) provides an arcuate working surface (26), which can engage with corresponding curvature of a massageable portion (2) of the body (3). In relation to a planar working surface, the arcuate working surface (26) can engage the corresponding curvature of the massageable portion (2) of the body (3) with greater uniformity, thereby providing a greater massage to the massageable portion (2) of the body (3). As but one illustrative example, the first concave lateral portion (8) can provide a second arcuate working surface (31) (as shown in the example of FIG. 7), which may be useful for massaging an inner longitudinal region of the sole of the foot (12), such as the medial portion of the plantar fascia or the medial longitudinal arch.

Again referring primarily to FIG. 2 through FIG. 7, the massage roller body (4) further includes a second concave lateral portion (9) axially extending between the second end portion (6) and the convex medial portion (7). In contrast to the first and second end portions (5)(6) and the convex medial portion (7) and akin to the first concave lateral portion (8), the second concave lateral portion (9) can be concavely arcuate along a second concave lateral portion length (32) (as shown in the example of FIG. 4).

As to particular embodiments, the second concave lateral portion (9) can be asymmetric about a second concave lateral portion vertical centerline (33) (as shown in the example of FIG. 6).

Now referring primarily to FIG. 5, the second concave lateral portion (9) has a second concave lateral portion minimum diameter (34) which is lesser than the convex medial portion maximum diameter (23) and the first and second end portion maximum diameters (24)(25). As such, upon use of the massage roller (1), the second concave lateral portion (9) does not engage with the support surface (20), as only the first and second end portions (5)(6) engage with the support surface (20).

Now referring primarily to FIG. 2 through FIG. 7, the second concave lateral portion (9) provides an arcuate working surface (26), which can engage with corresponding curvature of a massageable portion (2) of the body (3). In relation to a planar working surface, the arcuate working surface (26) can engage the corresponding curvature of the massageable portion (2) of the body (3) with greater uniformity, thereby providing a greater massage to the massageable portion (2) of the body (3). As but one illustrative example, the second concave lateral portion (9) can provide a third arcuate working surface (35), which may be useful for massaging an outer longitudinal region of the sole of the foot (12), such as the lateral portion of the plantar fascia or the lateral longitudinal arch.

Now referring primarily to FIG. 4, as to particular embodiments, the massage roller (1) can have the first concave lateral portion minimum diameter (30) configured to be greater than the second concave lateral portion minimum diameter (34). This particular configuration may be preferable for a massage roller (1) intended to be useful for simultaneously massaging a plurality of massageable portions (2) of a foot (3), whereby a medial plantar portion of the foot (12) downwardly extends a lesser distance from a transverse plane of the foot (12) in relation to a lateral plantar portion of the foot (12), which downwardly extends a greater distance from the traverse plane of the foot (12). Accordingly, when the massage roller (1) engages with a support surface (20), the first concave lateral portion (8), having a greater diameter, can abuttingly engage with the medial plantar portion, which downwardly extends a lesser distance from the transverse plane of the foot (12), while the second concave lateral portion (9), having a lesser diameter, abuttingly engages with the lateral plantar portion, which downwards extends a greater distance from the transverse plane of the foot (12), facilitating simultaneous massaging of both the medial and lateral plantar portions of the foot (12). Additionally, the convex medial portion (7) can abuttingly engage with a central longitudinal region of the sole of the foot (12) for further simultaneous massaging.

Again referring primarily to FIG. 4, as to particular embodiments, the massage roller (1) can have the first concave lateral portion length (28) configured to be lesser than the second concave lateral portion length (32). This particular configuration may be preferable for a massage roller (1) intended to be useful for simultaneously massaging a plurality of massageable portions (2) of a foot (12), whereby a medial plantar portion of the foot (12) has a lesser width (along a foot latitudinal axis in perpendicular relation to the foot longitudinal axis (13)) in relation to a lateral plantar portion of the foot (12), which has a greater width (along the foot latitudinal axis). Accordingly, when the massage roller (1) engages with a support surface (20), the first concave lateral portion (8), having a lesser length, can abutting engage with the medial plantar portion, which has a lesser width, while the second concave lateral portion (9), having a greater length, abuttingly engages with the lateral plantar portion, which has a greater width, facilitating simultaneous massaging of both the medial and lateral plantar portions of the foot (12). Additionally, the convex medial portion (7) can abuttingly engage with a central longitudinal region of the sole of the foot (12) for further simultaneous massaging.

Accordingly, the massage roller (1) provides at least three arcuate working surfaces (27)(31)(35) configured to simultaneously massage at least three massageable portions (2) of a foot (12).

Figure 11:
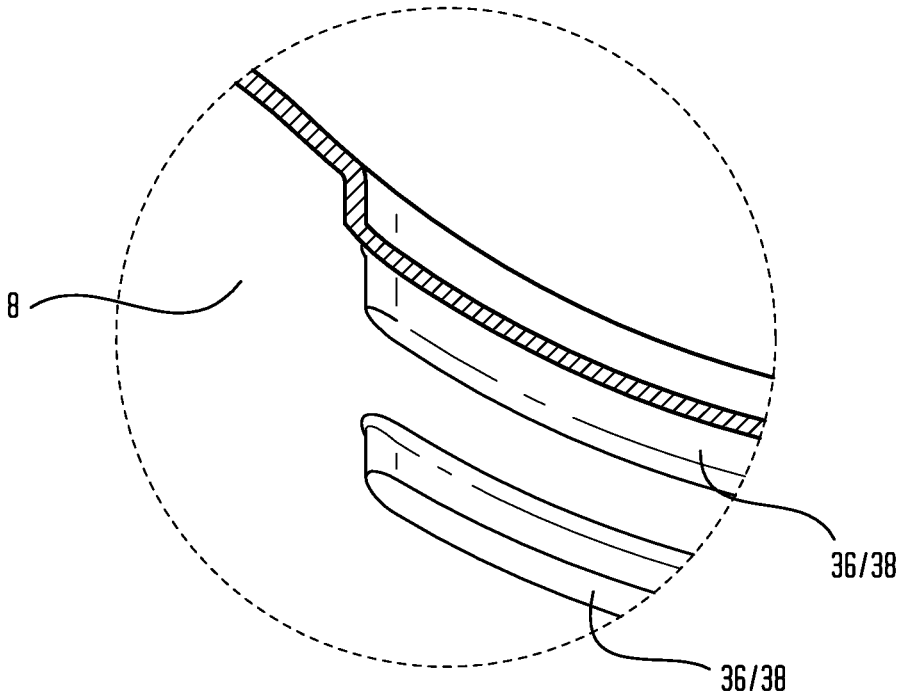
FIG. 11 is an enlarged view of a substantially linear recess of the particular embodiment of the massage roller shown in FIG. 10.
Figure 12:
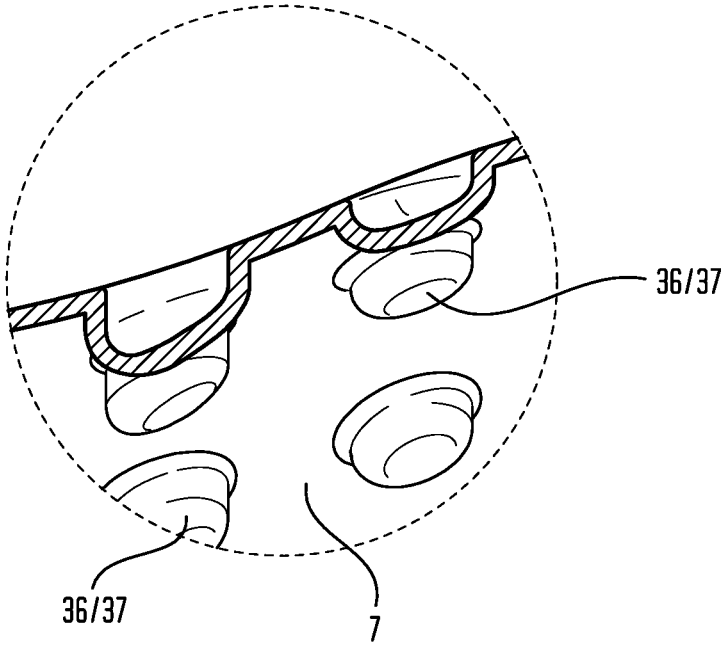
FIG. 12 is an enlarged view of a substantially circular recess of the particular embodiment of the massage roller shown in FIG. 10.

Now referring primarily to FIG. 2 through FIG. 12, the convex medial portion (7), the first concave lateral portion (8), the second concave lateral portion (9), or combinations thereof, can, but need not necessarily, include one or more recesses (36) disposed within the corresponding external surface (11), whereby the recesses (36) can facilitate massaging of the massageable portion (2) of the body (3). As but one illustrative example, a plurality of substantially circular recesses (37) can be disposed within the external surface (11) of the convex medial portion (7) in a desired spaced apart relation and a plurality of substantially linear recesses (38) can be disposed within the external surfaces (11) of each of the first and second concave lateral portions (8)(9) to facilitate massaging of corresponding massageable portions (2) of the body (3) (as shown in the examples of FIG. 10 through FIG. 12).

As to other particular embodiments, the convex medial portion (7), the first concave lateral portion (8), the second concave lateral portion (9), or combinations thereof, can, but need not necessarily, include one or more protrusions (not shown) outwardly extending from the corresponding external surface (11), whereby the protrusions can facilitate massaging of corresponding massageable portions (2) of the body (3).

As to yet other particular embodiments, the convex medial portion (7), the first concave lateral portion (8), the second concave lateral portion (9), or combinations thereof, can, but need not necessarily, include a combination of one or more recesses (36) and one or more protrusions (not shown), as described above.

Now regarding production, a method of making the massage roller (1) includes providing a massage roller body (4) comprising a generally circular cross section, opposing first and second end portions (5)(6), a convex medial portion (7), a first concave lateral portion (8) axially extending between the first end portion (5) and the convex medial portion (7), and a second concave lateral portion (9) axially extending between the second end portion (6) and the convex medial portion (7), whereby the massage roller body (4) is asymmetric about a massage roller body vertical centerline (10) (as shown in the example of FIG. 5).

The method of making the massage roller (1) can further include providing additional components of the massage roller (1) as described above.

The massage roller (1) or elements of the massage roller (1) can be made by any of a numerous and wide variety of processes depending upon the application, such as press molding, injection molding, fabrication, machining, printing, additive printing, or the like, or combinations thereof, as a one-piece construct or provided as a plurality of pieces for assembly into an embodiment of the massage roller (1).

Figure 14:
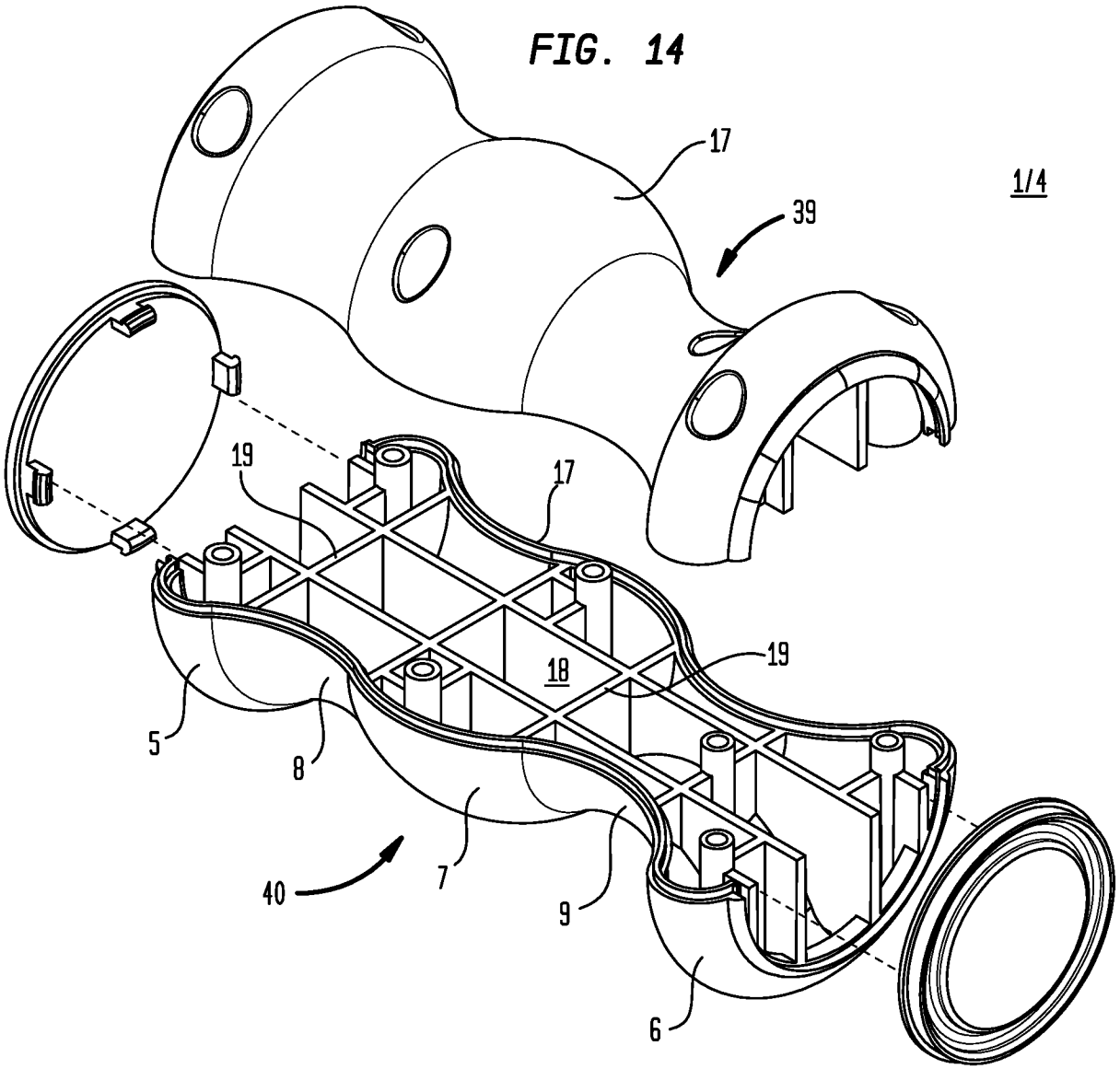
FIG. 14 is a perspective view of a particular embodiment of the massage roller formed from first and second pieces.

Now referring primarily to FIG. 14, which illustrates a particular embodiment of the massage roller (1) formed from first and second pieces (39)(40), whereby each piece (39)(40) comprises one of two longitudinal halves of the massage roller (1), the first and second pieces (39)(40) mateably engagable for assembly into an embodiment of the massage roller (1).

As can be easily understood from the foregoing, the basic concepts of the present invention may be embodied in a variety of ways. The invention involves numerous and varied embodiments of a massage roller and methods for making and using such massage rollers, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "roller" should be understood to encompass disclosure of the act of "rolling"—whether explicitly discussed or not—and, conversely, were there effectively disclosure of the act of "rolling", such a disclosure should be understood to encompass disclosure of a "roller" and even a "means for rolling". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Additionally, all directional references (e.g., proximal, distal, upper, lower, upward, downward, left, right, lateral, front, rear, back, top, bottom, above, below, vertical, horizontal, clockwise, and counterclockwise) are only used for identification purposes to aid the reader's understanding of the present invention, and do not create limitations, particularly as to the position, orientation, or use of the invention.

Thus, the applicant(s) should be understood to claim at least: i) each of the massage rollers herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A massage roller comprising:

a massage roller body terminating in opposing first and second end portions, each convexly arcuate along a corresponding end portion length;

a convex medial portion;

a first concavely arcuate lateral portion axially extending from said first end portion to said convex medial portion; and a second concavely arcuate lateral portion axially extending from said second end portion to said convex medial portion;

said massage roller body asymmetric about a massage roller body vertical centerline;

wherein said second end portion comprises a second end portion maximum diameter;

wherein said second concavely arcuate lateral portion comprises a second concavely arcuate lateral portion minimum diameter;

wherein said second concavely arcuate lateral portion minimum diameter comprises a smallest diameter of said massage roller body; and wherein said second concavely arcuate lateral portion minimum diameter is disposed (i) a first distance from said massage roller body vertical center and (ii) a second distance from said second end portion maximum diameter, said first distance lesser than said second distance.

2. The massage roller of claim 1, wherein said massage roller body comprises a body wall which defines a substantially hollow interior cavity having a plurality of supports disposed therein and filled with only gas.

3. The massage roller of claim 1, said first and second end portions configured to directly engage with a support surface during use of said massage roller.

4. The massage roller of claim 3, wherein said convex medial portion has a convex medial portion maximum diameter which is lesser than (i) a first end portion maximum diameter of said first end portion and (ii) said second end portion maximum diameter.

5. The massage roller of claim 4, wherein said convex medial portion provides a first arcuate working surface configured as a substantially spherical working surface.

6. The massage roller of claim 5, wherein said substantially spherical working surface is contoured to abuttingly engage with a central longitudinal region of a sole of a foot during use of said massage roller.

7. The massage roller of claim 6, wherein said first concavely arcuate lateral portion is asymmetric about a first concavely arcuate lateral portion vertical centerline.

8. The massage roller of claim 7, wherein said first concavely arcuate lateral portion has a first concavely arcuate lateral portion minimum diameter which is lesser than said convex medial portion maximum diameter and said first and second end portion maximum diameters.

9. The massage roller of claim 8, wherein said first concavely arcuate lateral portion provides a second arcuate working surface which is contoured to abuttingly engage with a medial plantar portion of said foot during use of said massage roller.

10. The massage roller of claim 9, wherein said second concavely arcuate lateral portion is asymmetric about a second concavely arcuate lateral portion vertical centerline.

11. The massage roller of claim 10, wherein said second concavely arcuate lateral portion minimum diameter is lesser than said convex medial portion maximum diameter and said first and second end portion maximum diameters.

12. The massage roller of claim 11, wherein said second concavely arcuate lateral portion provides a third arcuate working surface which is contoured to abuttingly engage with a lateral plantar portion of said foot during use of said massage roller.

13. The massage roller of claim 12, wherein said first concavely arcuate lateral portion minimum diameter is greater than said second concavely arcuate lateral portion minimum diameter.

14. The massage roller of claim 12, wherein said massage roller is configured to simultaneously massage said medial plantar portion of said foot, said lateral plantar portion of said foot, and said central longitudinal region of said sole of said foot.

15. The massage roller of claim 14, wherein a first concavely arcuate lateral portion length of said first concavely arcuate lateral portion is lesser than a second concavely arcuate lateral portion length of said second concavely arcuate lateral portion.

16. The massage roller of claim 1, further comprising one or more recesses disposed within an external surface of one or more of said convex medial portion, said first concavely arcuate lateral portion, or said second concavely arcuate lateral portion.

17. The massage roller of claim 1, wherein said massage roller body is continuously arcuate along its length.

18. A massage roller comprising:

a massage roller body terminating in opposing first and second end portions, each convexly arcuate along a corresponding end portion length;

a convex medial portion;

a first concavely arcuate lateral portion axially extending from said first end portion to said convex medial portion; and a second concavely arcuate lateral portion axially extending from said second end portion to said convex medial portion;

wherein a first concavely arcuate lateral portion minimum diameter is greater than a second concavely arcuate lateral portion minimum diameter;

wherein said second concavely arcuate lateral portion minimum diameter comprises a smallest diameter of said massage roller body;

wherein said second end portion comprises a second end portion maximum diameter; and wherein said second concavely arcuate lateral portion minimum diameter is disposed (i) a first distance from a massage roller body vertical center and (ii) a second distance from said second end portion maximum diameter, said first distance lesser than said second distance.

19. The massage roller of claim 18, wherein said massage roller body is continuously arcuate along its length.

* * * * *